FIG. 5.
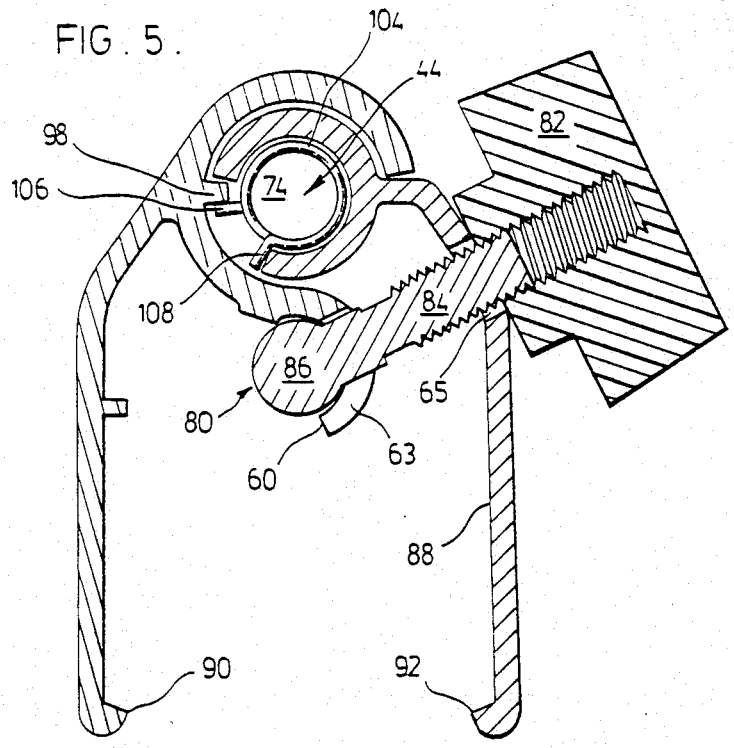
FIG. 6.
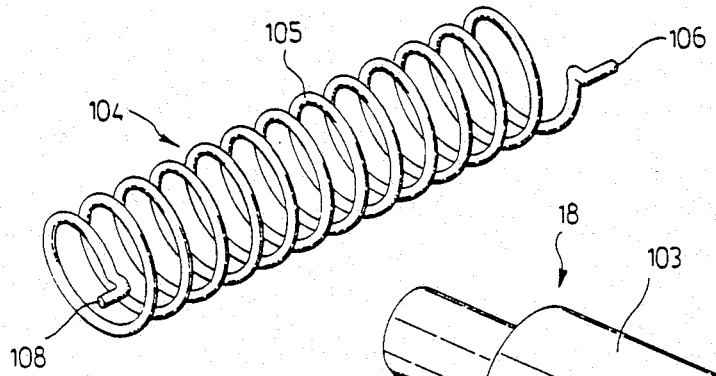
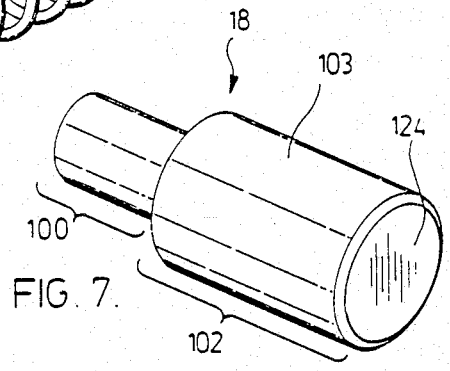
FIG. 7.

10
12
16
26
28
30
32
36
74
110
112
114
116
118
120
122
126
128
130
132
134
136
138
140
142
148
CG

TWO PIECE CLAMP BINDER

BACKGROUND OF THE INVENTION

This invention relates generally to clamp binders for holding sheet material such as maps, blueprints and plans. More particularly the invention relates to new configurations for such clamp binders as well as to a new support structure for horizontally suspending new and known clamp binders.

In vertical filing systems, clamp binders are used to bind large sheets of material including engineering and architectural plans and drawings, maps, specifications, and blueprints. The clamp binder grasps the sheet-like material along an edge thereof to frictionally hold the material in the binder. The binder may then be suspended in a substantially horizontal position from a support structure whereby the sheet material hangs vertically from the clamp binder. Such vertical filing systems preferably provide for ease of examination, handling and storage of sheet material.

Known binders include "three piece binders" such as characterized in Canadian Pat. No. 604,233 to Schneider and U.S. Pat. Nos. 3,891,093 and 3,308,831 to Petrie and Kritske, respectively. These three piece binders include an inverted channel member carrying therein a pair of clamping members.

The upper edges of the clamping members are hinged inside the channel and coupled to a threaded bolt extending upwardly through the channel to a wing nut on the exterior top surface of the channel. Turning the wing nut draws the bolt upward, rotating the upper edges of the clamping members about their hinges, and causing the lower edges of the clamping members, which protrude from the channel, to clamp about sheet material to be held.

Some "two piece binders" have also been proposed as in U.S. Pat. No. 3,069,737 to Schneider. These two piece binders are characterized by two clamping members hinged together with threaded bolts and wing nuts co-operating to draw complementary edges of the clamping members together to grasp sheet material therebetween. Two piece binders proposed to date have not proved satisfactory and suffer from a number of disadvantages. One disadvantage is that they do not provide a satisfactory hinge between the clamping members. Another disadvantage is that the configurations of the clamping members do not permit efficient transfer of tensioning forces created by the bolt and wing nut into clamping forces acting on the sheet material to be held.

A disadvantage common to most two and three piece binders is that the conventional wing nuts used to create the clamping forces are located on the exterior top surface of the binder. Known binders may most conveniently be laid on their side, as on a desk top, to insert sheet material between open clamping members. With binders having wing nuts mounted on the top surface of the binder, the desk top typically interferes with the wing nuts and, in any event, the proximity of the wing nut to the desk top prevents easy and satisfactory manual turning of the wing nuts to tightly clamp the binder onto the sheet material being inserted.

Most three piece binders are arranged so that the sheet material will hang straight down from the channel member between symmetrical clamping members. Known two piece binders fail to satisfactorily achieve such a symmetrical arrangement. Those two piece clamps which have attempted to approximate a symmetrical arrangement have found it necessary to locate the adjusting wing nuts on the top surface of a channel-like member forming one of the clamping members. Known two piece clamp binders have failed to provide symmetrical grasping members in combination with side mounted wing nuts.

Known systems for hanging binders include a simple system comprising two parallel, spaced, horizontal bars across which a binder may be suspended with one end of the binder supported on one bar and another end of the binder supported by the other bar. Such a system is for example referred to in U.S. Pat. No. 3,308,831 to Kritske. Parallel bar systems have the disadvantage that when a number of binders are stored adjacent each other, great difficulty is to be experienced in lifting out any intermediately located binder, particularly having regard to the substantial weight of a loaded binder.

To overcome this problem, hinged bracket support systems have been proposed such as in Canadian Pat. No. 671,574 to Schneider and U.S. Pat. No. 3,211,892 to Morcheles. In these systems, a number of adjacent brackets are placed at spaced intervals along a wall with each bracket hinged to rotate about a vertical axis. Each bracket independently receives and supports a binder such that the bracket and binder will rotate as a unit. With binders suspended side-by-side on separate brackets, access to any binder is facilitated by rotating adjacent binders away therefrom. In such systems, coupling means are provided to couple the binder to the bracket, typically coupling the binder to the bracket at two separate points of support. Known hinged bracket support systems have the major disadvantage that, in order to couple the binder to the bracket or disengage the binder from the bracket, substantially the entire weight of the binder must not only be lifted but must also be carefully manipulated. Prior art vertical filing systems thus fail to provide a system in which access to and removal or replacement of the binder can be carried out quickly and with a minimum of effort.

Another disadvantage of hinged support systems is that after adjacent binders have been pushed aside to rotate away from the desired binder, no means is provided to automatically swing the binders back to a normal storage position, in which position typically a minimum of space is occupied by the suspended binders.

With an understanding of hinged bracket support systems, a mutual disadvantage of hinged bracket support systems and known two and three piece binders may be pointed out. In many cases where a binder is coupled to a hinged bracket support system, the disadvantage arises that the effective location of the coupling means coupling the binder to the bracket will be such that the center of gravity of the binder and grasped sheet material is not effectively centered about the coupling means. The off-centered weight of the binder and sheet material disadvantageously produces a force moment attempting to rotate the suspended binder about its longitudinal axis. This rotational moment makes coupling and disengagement of the binder more difficult in that in manually manipulating the binder, not only must the weight of the binder be supported but the rotational force must be overcome to achieve a proper orientation of the binder for coupling or disengagement.

such as known two and three piece binders, in substantially horizontal positions. As with known vertical filling systems, suspending a binder horizontally from the support structure of the present invention permits sheet material which may be grasped in the binder to hang vertically downward from the suspended binder. The support structure of this invention has an end support means which is fixedly secured to the support structure and adapted to receive a first end of a binder. An elongate suspension means is provided with one of its ends coupled to the support structure at a position located above the end support means. The suspension means extends from its end coupled to the support structure to its other end where it is adapted to be detachably coupled to the binder at a location on the binder spaced from the end of the binder received in the end support means. Upon choosing the elongate structure to be of a suitable length, with the first end of the binder received in the end support means and the suspension means coupled to the binder, the binder may be suspended from the support structure in a substantially horizontal position. Preferably the binder is suspended so that the binder may be pivoted, while maintaining its substantially horizontal position, about a vertical axis passing near the first end of the binder. This may be accomplished, firstly, by having the first end of the binder received in the fixed end support means to permit at least some rotation of the binder about a vertical axis passing proximate the end support means and, secondly, by having the elongate suspension means coupled to the support structure to permit the elongate suspension means to also be rotatable about a vertical axis.

The preferred embodiments of the support structure according to the present invention facilitate ease of insertion of a binder into the support structure with the end support means receiving the first end of the binder so as to prevent relative vertical downward movement of the first end of the binder with respect to the end support means. The preferred embodiments provide a simplified construction for the support structure as compared to known support structures particularly when simple rods or straps are used as the elongate suspension means.

Another object of the present invention is to at least partially overcome the disadvantages of the prior art by providing a novel method for suspending elongate binders which comprises suspending the binders from a support structure such that the binders are free to pivot about an axis passing longitudinally through the binder.

Accordingly, in a third aspect the present invention provides an improved method of suspending an elongate clamping device, adapted to grasp sheet material therein, from a support structure so as to permit the device to pivot at least marginally about an axis passing longitudinally through the device.

In the third aspect of the invention, the applicant has appreciated that force moments may disadvantageously act on suspended binders due to the sheet material hanging therefrom tending to pivot the binder about a hoirzontal axis passing through the binder. To permit a suspended binder to assume an aadvantageous position in which these rotational forces are minimized, the present invention provides for supporting the binder from the support structure such that the binder is substantially free from restraint to pivot about a longitudinal axis. While both sectionally symmetrical and sectionally non-symmetrical binders may be suspended so as to permit such preferred pivoting of the binder with respect to the support structure, suspension according to the third aspect of the present invention is especially preferable in clamping binders, such as two or three piece binders, in which two clamping members are hinged together about an axis and the binder is suspended to be free to pivot about this axis.

BRIEF DESCRIPTION OF THE DRAWINGS

Further objects and advantages of the invention will appear from the following description taken together with the accompanying drawings in which:

FIG. 5 is a cross sectional end view similar to that of FIG. 4 but with the binder in an open position.

FIG. 6 is a pictorial view of a biasing spring.

FIG. 7 is a pictorial view of an end cap.

DESCRIPTION OF THE PREFERRED EMBODIMENTS

Figure 1:
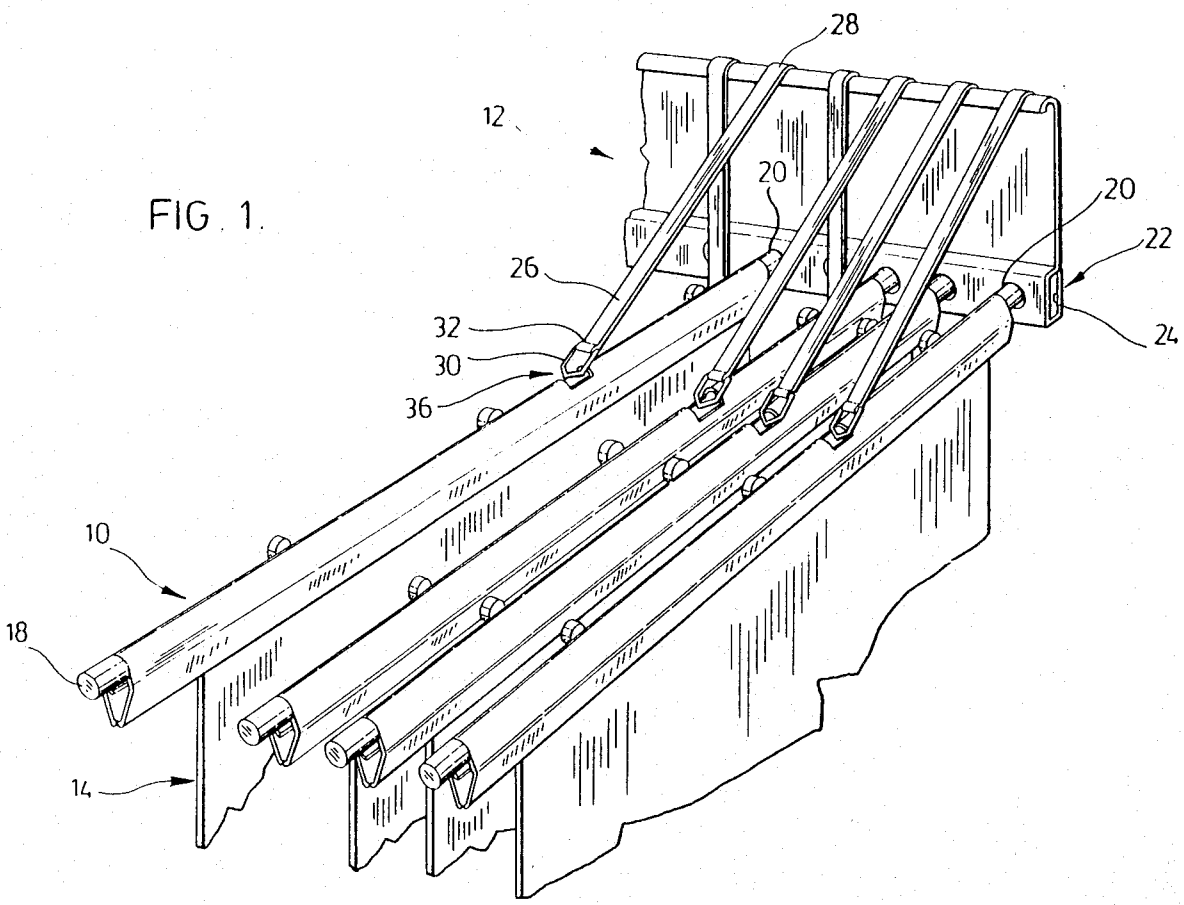
FIG. 1 is a perspective view of a new binder according to the present invention shown suspended by one form of a new support structure according to the present invention.

Reference is made first to FIG. 1 which shows a vertical filing system including elongate binders 10 suspended in a substantially horizontal position from first preferred form of a support structure generally designated 12 whereby sheet-like material 14 grasped by each binder 10 may freely hang vertically from the binder. Support structure 12 is affixed by known means to a support (not shown) such as a wall or a movable stand.

Each end of the binder 10 has a cylindrical end extension or cap 18 extending therefrom. The end cap 18 at one end of the binder is received within a circular opening 20 in a substantially hollow square rod-like member 22 formed in support structure 12. The end surface of end cap 18 abuts a rear surface 24 in square rod-like member 22. A flexible strap 26 is secured at a first end 28 thereof to support structure 12 vertically above opening 20. Flexible strap 26 has a hook 30 at its second end 32. While not clearly shown in FIG. 1, hook 30 has a cylindrical projection which extends into a cylindrical interior aperture inside binder 10, with ingress and egress of the cylindrical projection being accomplished via opening 36 through top of binder 10. Strap 26 is of length that with the first end of the binder received in opening 20 to abut against the rear interior surface of square rod-like member 22, binder 10 is disposed in a substantially horizontal position.

FIGS. 2 to 5 clearly show the features of a preferred embodiment of a new two piece binder according to the present invention. The binder comprises two major pieces; a first jaw-like clamping member 40 shown in section in FIG. 2 and a second jaw-like clamping member 42 shown separately in section in FIG. 3. Each comprises a substantially continuous, elongate member, preferably extruded from aluminum.

Figure 4:
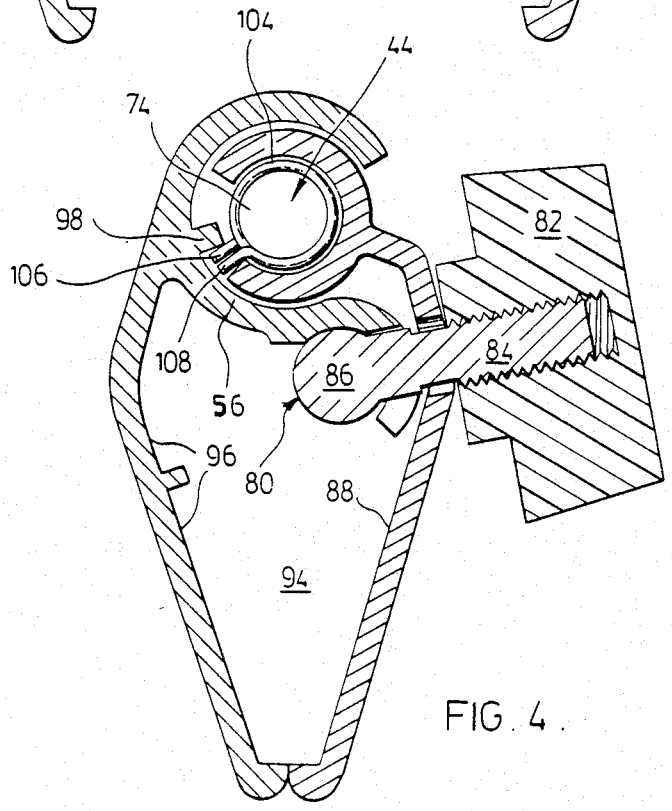
FIG. 4 is a cross sectional end view of a binder according to the present invention in a fully closed position.

As shown most clearly in FIGS. 4 and 5, the first and second members 40, 42 may be hinged together at their upper edges to rotate with respect to one another about an axis indicated at 44. This is accomplished in the present embodiment by a first C-shaped member being provided at the first edge of the first clamping member 40 to receive therein a second C-shaped member generally being provided at the first edge of the second member 42.

Figure 2:
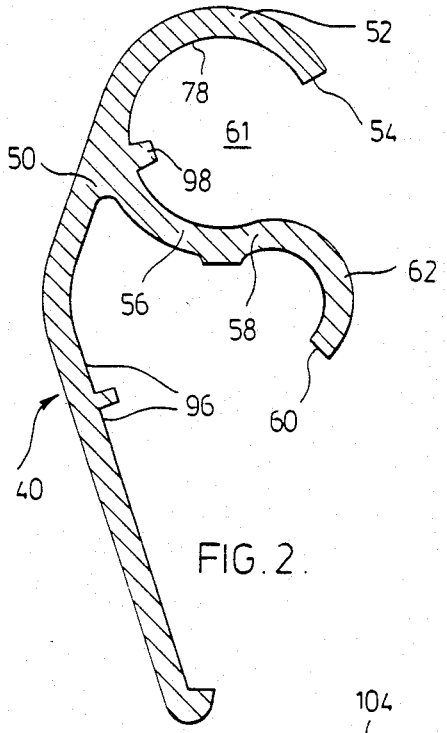
FIG. 2 is a cross sectional view of a first clamping member of a binder.

As seen in FIG. 2, the first clamping member bifurcates at point 50 into two separate portions. The first C-shaped member comprises a first outer most arm 52 extending from point 50 to extremity 54 and a second inner most arm 56 extending from point 50 to point 58 wherein the curvature diverges from a circumferential path around axis 44. As discussed later, the extension from point 58 to extremity 60 is to be referred to as the depending flange 62. The first C-shaped member may be seen to define therein, by its interior surface 78, a longitudinally extending groove 61 of part-circle section.

Figure 3:
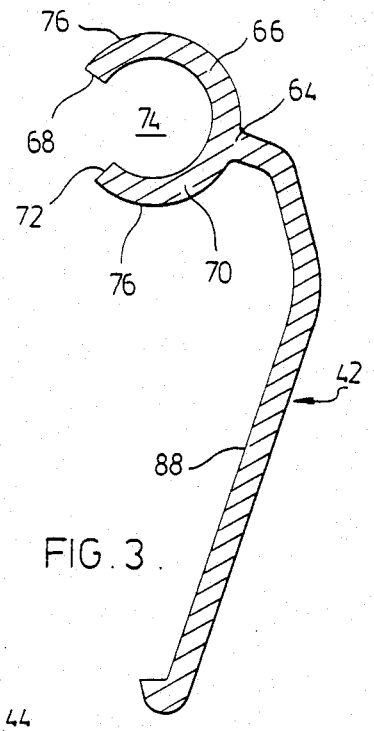
FIG. 3 is a cross sectional view of a second clamping member of a binder.

As may be seen in FIG. 3, the second member 42 is similarly divided at point 64 into two arms, a first outermost arm 66 extending from point 64 to extremity 68 and a second arm 70 extending from point 64 to extremity 72. The first and second arm 66 and 70 form the second C-shaped member in section defining therein a longitudinally extending substantially cylindrical central aperture 74. The second C-shaped member also has an outer surface 76 of part-circle section. The diameter of outer cylindrical surface 76 on the second C-shaped member is marginally smaller than the diameter of groove 61 of part-circle section formed by the first C-shaped member whereby the second C-shaped member of the second member 42 is, for assembly of the binder, longitudinally slidable into the first C-shaped member of the first member 40. Inner cylindrical surface 78 on the first C-shaped member cooperates with the outer cylindrical surface 76 of the second C-shaped member so as to hinge the first member and second member together for rotation about axis 44.

Preferably groove 61 of the first C-shaped member encircles the second C-shaped member to an extent greater than 180° to prevent removal of the second C-shaped from groove 61 by movement in a radial direction with respect to axis 44.

Means are provided on the binder to rotate the first and second member with respect to one another about axis 44. These means include depending flange 62, T-bolt 80 and nut 82. Depending flange 62 is preferably located on the first clamping member 40 to extend from point 58, the designated end of second arm 56, to extremity 60. Depending flange 62 forms in section a third C-shaped member (also designated as 62) whereby in conjunction with the first C-shaped member may be seen to form an S-shape in section (or of inverted S-shape). As best seen in FIG. 5, depending flange 62 is provided with one narrow slot 63 extending upwardly from extremity 60 through which center post 84 of T-bolt 80 may pass. A hole 65 is provided through second member 42 passing from the interior surface 88 of the second member 42 to its exterior side surface, in section, in alignment with the slot 63 in the depending flange 62. With the cylindrical rod-like head 86 of T-bolt 80 located within the third C-shaped member 62, center post 84 may extend through both U-shaped slot 63 and hole 65 to outside the binder 10. Preferably U-shaped slot 63 and hole 65 have sufficient dimension having regard to the diameter of central post 84 of T-bolt 80 so as to permit angular movement of post 84 with respect to the first and second clamping members 40, 42 as is to be appreciated to take place in relative rotation of members 40, 42 between the closed position shown in FIG. 4 and the open position shown in FIG. 5.

A threaded portion of post 86 is engaged within threaded nut 82 located along the side of the binder over hole 65. Turning nut 82 will rotate first and second members, 40, 42, relative to one another from a fully open position as shown in FIG. 5 to a fully closed position as shown in FIG. 4. In a fully open position, sheet material may be inserted between the lower second edges 90, 92 of clamping members 40, 42 respectively. The first and second members may then be rotated towards a closed position whereby sheet material is grasped between the second edges 90, 92 of members 40, 42 respectively, to be frictionally held therebetween.

As shown in FIGS. 4 and 5, clamping members 40, 42 are preferably of substantially identical angle section. Thus, first member 40 and second member 42, in section, extend downwardly from respective points 50, 64 to respective second edges 90, 92 symmetrically about opposite sides of a plane passing through axis 44.

Each member 40, 42 are preferably of overall angle section with the angle sections opening towards one another whereby an interior space 94 is seen in FIG. 4 to be provided defined by interior surfaces 96 of the first member 40 and interior surfaces 88 of the second member 42. Depending flange 62 may be seen to extend from a portion of the interior surface 96 of the first member towards the inner surface 88 of the second member with portions of depending flange 62 lying proximate to and in opposing relation to the inner surface 88 of the second member when the first and second member 40, 42 are in a substantially closed position To facilitate manufacture by extrusion, depending flange 62 as shown in the figures has been selected to extend from first clamping member 40 and to comprise an arcuate extension of the innermost arm 56 of first member 40. Alternatively, the depending flange could be provided to extend from virtually any portion of either the interior surface 96 of the first member 40 or the interior surface 88 of the second member 42. The depending flange should lie intermediate the first and second members 40, 42 in the interior space 94 with the depending flange in section extending from the interior surface of one of clamping members 40, 42 towards the interior surface of the other of clamping members 40, 42. With the binder in a closed position, a portion of the depending flange advantageously should lie proximate the interior surface of such other of clamping members 40, 42 in opposed relation thereto. Tensioning means, exemplified in the figures by a threaded T-bolt, coupling such portion of the depending flange to such other of clamping members 40, 42 may then be provided for activation to regulate the distance between such portion and the interior surface of such other of clamping members 40, 42 opposed thereto whereby the clamping members 40, 42 may be rotated relative to one another.

Tension activating means, exemplified in the figures by threaded nut 82, advantageously are located on an exterior side surface of such one of members 40, 42 to activate the tensioning means.

Preferably a stop flange 98 extends radially inward from inner surface 78 of the first C-shaped member. Advantageously stop flange 98 is located at a circumferential location on surface 78 to lie intermediate extremities 68 and 72 on the second C-shaped member. As shown in FIG. 5, stop flange 98 will abut extremity 68 to prevent rotation of members 40, 42 past a fully open position. Similarly as seen in FIG. 4, stop flange 98 will effectively abut extremity 72 to prevent rotation past a fully closed position.

Stop flange 98 may be seen to extend radially inward but only to an extent that it does not protrude into the central aperture 74 in the second C-shaped member. Central aperture 74 may thus include a space completely circular in section. Cap 18 of the binder as shown in FIG. 7 is adapted to frictionally slide into aperture 74 at either end of the binder. When interior portion 100 of end cap 18 is inserted into aperture 74, the outer portion 102 comprises a longitudinal extension of the binder with a cylindrical surface 103 coaxial with axis 44.

Preferably, spring means are provided to bias the first and second member 40, 42 to an open position. Biasing spring 104 as shown in FIG. 6 has a coil 105 of a diameter sufficiently small to be slidably received inside central cylindrical aperture 74 in the second C-shaped member. Spring 104 also has two radial extensions one on each of its extremities extending radially from the coil. With the first and second members 40, 42 in a fully open position, the spring 104 is inserted into cylindrical apertures 74 with the two radial extensions 106, 108 located between one side of stop flange 98 and extremity 72 on the second inner arm 70 of the second C-shaped member. On rotating the first and second members 40, 42 towards the closed position, the stop flange 98 will engage one radial extension 106 while extremity 72 will engage the other radial extension 108 drawing them towards each other, winding the spring 104 and thereby developing a bias tending to urge the first and second members, 40, 42 towards an open position.

Figures 8, 10:
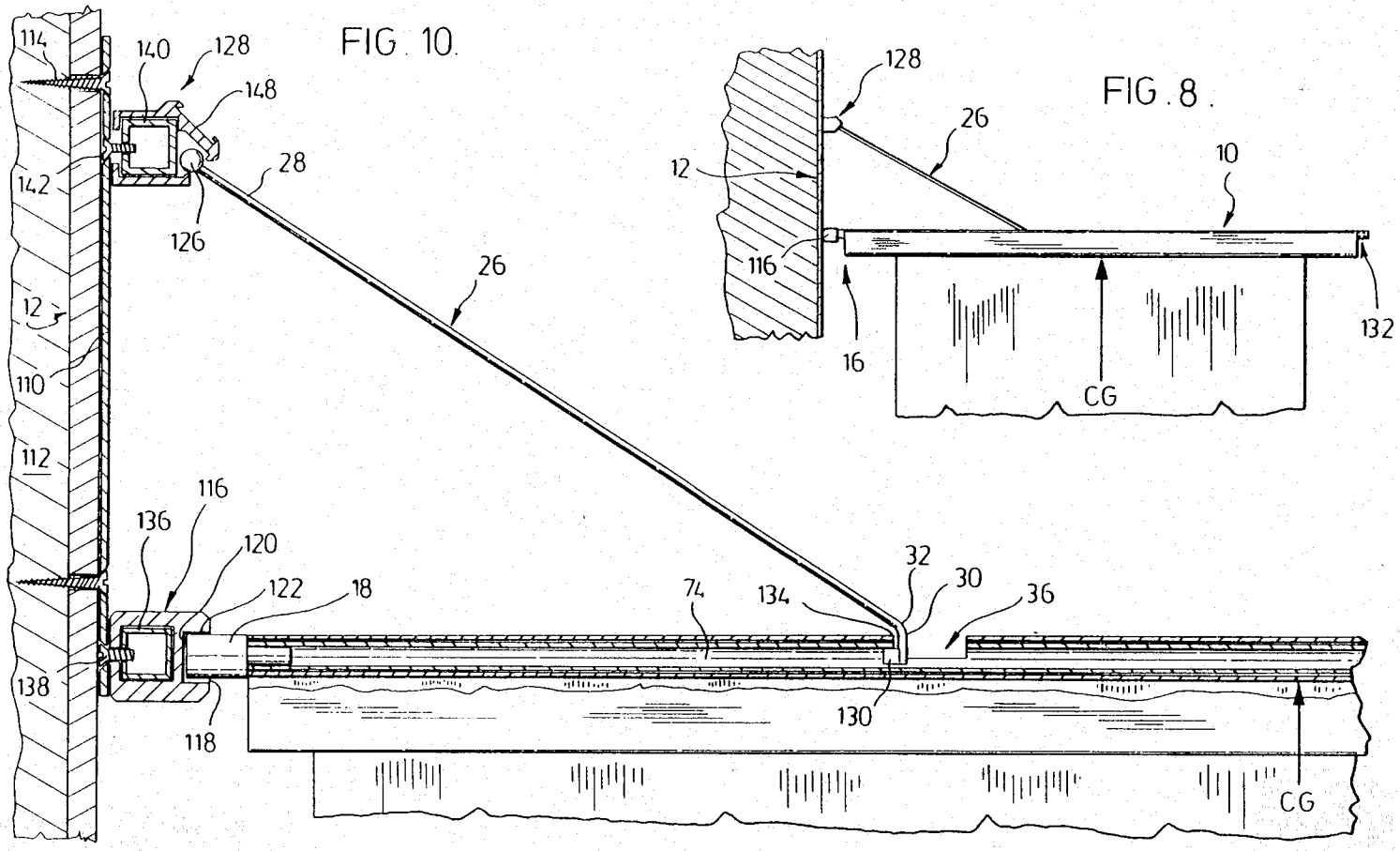
FIG. 8 is a schematic side view of a binder suspended from a second form of a new support structure according to the invention.
FIG. 10, located on the sheet with FIG. 8, is a partial cross sectional view of FIG. 9 along axis I—I'.
Figure 9:
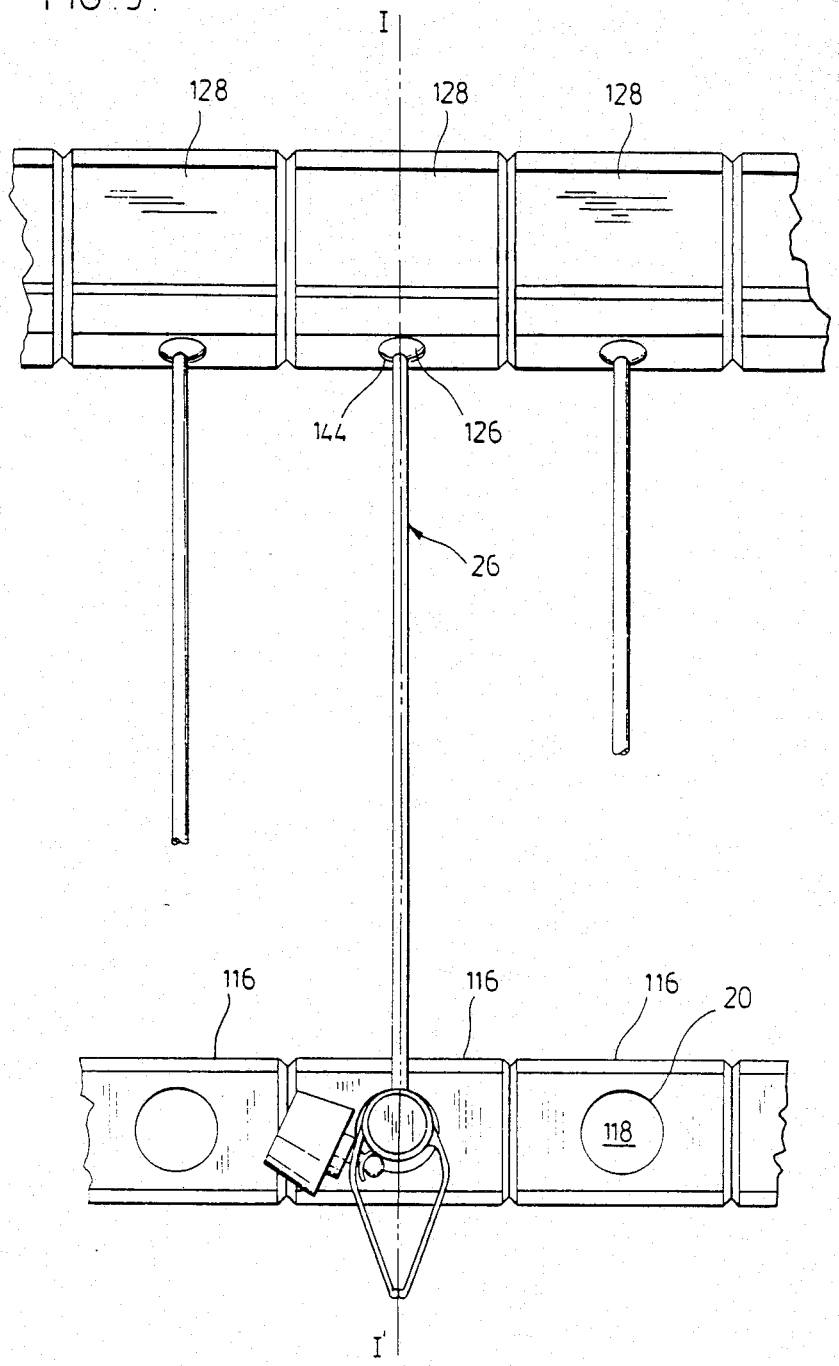
FIG. 9 is a front view of the second form of a new support structure according to the invention showing one binder suspended therefrom.

Reference is now made to FIGS. 8, 9 and 10 which show a second preferred form of a support structure according to this invention. Many elements of this second form have equivalent elements in the first form of the support structure shown in FIG. 1 and like reference number are used to indicate similar elements.

FIG. 8 schematically shows binder 10 suspended from support structure 12 with a first end 16 of the binder received in end support means 116 and a second end 132 remote therefrom. Elongate suspension means 26 extends from support structure 12 to the binder in this embodiment coupling to the binder at a location between first end 16 and the binder's center of gravity marked as the upward arrow CG on FIG. 8.

As more specifically shown in FIGS. 9 and 10, the support structure generally indicated at 12 comprises a spacer or structural plate 110 for attachment to a wall 112 by fastening means such as screws 114. A number of spaced end receiving means generally indicated as 116 are provided at the lower end of plate 110. Each end receiving means 116 has a horizontally disposed cylindrical recess herein referred to as recess or recession 118 with interior surfaces including end wall 120 and cylindrical side walls 122. Recession 118 opens forwardly as a circular opening 20.

Recession 118 is a depth which is less than the length of the outer portion 102 on end cap 18 so that with cap 18 received in recession 118, end face 124 of cap 18 may abut against end wall 120. Recession 118 has a diameter whereby with cap 18 received therein, room is provided for pivoting of binder 10 about axis formed at the interface of abuttment between the interior surfaces of recession 118 and the exterior surfaces of the outer portion 102 of cap 18, namely cylindrical surface 103 and end face 124.

The support structure includes an elongate suspension means 26, in this embodiment, being an integral rod 26 with a ball 126 at a first end 28 and a hook member 30 at its second end 32. Rod 26 is coupled via ball 126 at its first end 28 to a ball-socket means on the support structure generally indicated as 128 so as to permit pivoting of the rod with respect to the ball-socket means 128. The hook 30 on the second end 32 of rod 26 has a cylindrical protrusion 130 which is adapted to pass into and out of opening 36 in the top surface of binder 10 and to be received within central cylindrical aperture 74 of the second C-shaped member of binder 10. Rod 26 is selected to have a length such that with end cap 18 received in recession 118, and hook 30 engaged inside aperture 74, the binder 10 will be suspended substantially horizontally.

Attachment and removal of binder 10 to support structure 12 is easily accomplished as now described. To hang binder 10 from the support structure, firstly, with all the weight of the binder being carried by the person inserting the binder, end cap 18 of binder 10 is slidably inserted into recession 118. Recession 118 prevents vertical downward movement of the first end 16 of the binder and accordingly by manually lifting merely at the second remote end 132 of the binder, a person inserting the binder may support it in a substantially horizontally position in cooperation with recession 118. This may typically be accomplished with one hand by the inserting person, thus leaving the other hand free. The other hand may be used to grasp rod 26 which in an unused position will hang vertically downward from ball-socket means 128. With rod 26 swung to a position above opening 36 by the other hand, the one hand may lift the remote end of binder 10 thus pivotting the binder upward about its first end 16. As is to be appreciated, with binder 10 rotated sufficiently upward about its first end, the cylindrical protrusion 130 of hook 30 may be allowed to clear the inner edge 134 of opening 36, and enter aperture 74. With hook 30 guided into place in aperture 74 by the other hand, the operators one hand permits binder 10 to pivot downward whereby cylindrical protrusion 130 becomes receivably engaged in aperture 74 and the binder is suspended horizontally from support structure 12. Removal of binder 10 from suspension is easily accomplished by pivoting the second remote end 132 of binder 10 upwardly with one hand until hook 30 clears opening 36 and may be removed therefrom. Only then is the first end of binder 10 disconnected from recession 118 and the full weight of the binder 10 carried by the person removing the binder.

FIGS. 9 and 10 show a convenient method of mounting the recession 118 and ball-socket means 128 to the support structure. A plurality of modular end receiving means 116 containing recessions 118 are slidably received on a square bar 136 which is secured to plate 110 by fasteners 138. Similarly, a plurality of modular ball-socket means 128 are slidably received on a similar square bar 140 secured to plate 110 by fasteners 142. Each ball-socket means 128 has a front circular opening 144 which forms a seat to retain ball 126. Advantageously the ball-socket means may have a forward angled surface 148 above the ball-socket adapted to receive an indication tag to identify the binder to be hung therefrom.

The support structure of FIGS. 9 and 10 permit a suspended binder 10 to be swung from side to side to aid access to and removal of any binder hung between adjacent binders. Ball 126 and ball-socket means 128 couple rod 26 to the support structure so as to permit pivoting of rod 26 thereabout. The freedom of rotation of rod 26 includes freedom to pivot about a vertical axis passing through the center of ball 126. The end cap 18 on the first end 16 of binder 10 is received in recession 118 so as to permit pivoting of the binder about a vertical axis passing proximate first end 16. Recession 118 and end cap 18 are provided with complementary surfaces for abuttment whereby the first end of the binder will pivot about interfaces of abuttment between interior surfaces of recess 118 and exterior surfaces of cap 18.

With rod 26 free to pivot freely about a vertical axis passing through ball 126 and the binder 10 free to pivot about a vertical axis passing proximate its first end 16, it is to be seen that binder 10 when suspended as in FIG. 10 is free to be pivoted side-to-side about a vertical axis passing proximate its first end 16.

In the embodiment shown in FIG. 1 using a flexible strap as the suspension means 26, the flexibility of strap 26 permits pivoted of the strap about a vertical axis proximate its juncture with support structure 12.

Advantageously the binder and support structure provide for the self-centering of a suspended binder such that after pivoted to one side or another a binder will automatically return to a suspended position extending perpendicularly outward from plate 110. This result is obtained in embodiments of FIGS. 1, 9 and 10 by the interaction of the interior surfaces of recession 118 with the exterior surfaces of end cap 18. With hook 30 coupled to the binder on the side of the center of gravity of binder 10 closest to first end 16, the weight of binder 10 provides a force moment urging binder 10 to pivot clockwise about the hook as seen in FIG. 8 urging end cap 18 upwardly into recession 118. With the binder extending perpendicularly outward from plate 110, the axis of the cylindrical surface 122 of recess 118 and the axis 44 will lie in the same vertical plane. As the end cap 18 is of a diameter less than the diameter of recession 118, the end cap may assume the highest possible position in the central top portion of recession 118 with contact between surfaces taking place at a single point in the vertical upward center of recession 118. The relative diameters of recession 118 and cap 18 are chosen such that as binder 10 is progressively rotated towards one side about a vertical axis, the sectional area of the end cap 18 as seen in a plane normal to the axis of recession 118 will progressively increase. The exterior surface 103 of a cap 18 so rotated will no longer be able to retain single point contact with cylindrical surface 122 of recession 118 at its top center point. Cylindrical surface 103 of a cap 18 will come to contact the cylindrical surfaces 122 of recession 118 at two points and effectively, by pivoting of binder 10, cam end cap 18 to a lower position in recession 118 against a force moments tending to urge the end cap 18 upwardly. Accordingly, once the binder has been pivoted to one side, binder 10 will in response to this force moment, attempt to return to the lowest energy state with the end cap 18 in the highest point in recession 18.

The self-centering has been described with binder 10 coupled to rod 26 on the side of the center of gravity closest to the first end of the binder. If binder 10 were coupled to rod 26 on the remote side of the center of gravity from the first end, a similar self-centering would occur with the end cap 18 attempting to assume the lowest central portion in the cylindrical recession 118.

Another method by which self-centering may be accomplished is to have the center of ball 126 located farther forward from vertical plate 110 than the effective vertical axis about which the first end of binder 10 pivots in recession 118. In such an arrangement, the second end 132 of binder 10 will on pivoting of the binder side-to-side describe an upwardly extending arc, the lowest point of which arc will coincide with the position of the second end 132 when binder 10 is hung perpendicular to plate 110. In such an arrangement, the binder 10 will tend to assume the lowest energy position, the low point in the arc whereby returning to a centered position.

In the embodiment shown in FIG. 1 with a flexible strap 26, made for example, of DACRON* synthetic polyester fiber, sideway pivoting of binder 10 will distort the strap such that the strap, will tend to return the binder to a centered position.

*Trade Mark

The binders are advantageously provided with pivoting permitting means adapting the binders to be coupled to the support structure for suspension from the support structure substantially free from restraint from pivoting of the device as a unitary body about axis 44. As has been seen, first and second clamping members 40, 42 are hinged together to pivot about axis 44. Cap 18 is co-axially received in central cylindrical aperture 74 inside the second C-shaped member of second clamping member 42 so that the exterior surface 103 of end cap 18 is coaxial with axis 44. In the event binder 10 having end caps 18 received in each of its ends 16 and 132, were to be horizontally suspended between two suitably spaced, parallel, horizontal bars (not shown) with a first end cap 18 resting on a first bar and a second end cap 18 resting on a second bar, then binder 10 would be free to pivot about axis 44 as a unitary body. The binder 10 would then, with uniform, flexible sheets grasped therein, be free to pivot about axis 44 so as assume a position with the sheets extending vertically downward between the first and second members 40, 42.

A similar "free-rotation" suspension, may be achieved by the manner in which cylindrical protrusion 130 of hook 30 on bar 26 is received within central cylindrical aperture 74 inside the binder. As has been seen, aperture 74 has an inner cylindrical surface coaxial with axis 44. With the coefficient of friction between cylindrical protrusion 130 and the inner cylindrical surface of aperture 74 being minimal, advantageously a binder 10 when suspended as in FIG. 10 will be free to pivot about axis 44 to adopt a free-hanging position having regard to the nature of the sheet material grasped therein.

Opening 36 provides communication through members 40, 42 from the exterior of binder 10 into interior aperture 74. As to be appreciated from FIG. 10, opening 36 is formed by the overlap of an opening in first C-shaped member of member 40 and an opening in second C-shaped member of member 42. The circumferential extension of opening 36 about axis 44, firstly, should be sufficient that cylindrical protrusion 130 of hook 30 may pass through opening 36. Secondly, for advantageous "free-pivoting" suspension, the circumferential extent of opening 36 must be sufficient that hook 30 does not contact the side walls of aperture 74 so as to prevent free pivoting of the binder about axis 44. If a binder 10 grasping sheet material is suspended as shown in FIG. 10 and a vertical plane were drawn through axis 44, in section, the point at which this plane passes through the circumference of the first and second C-shaped members will vary depending upon the number of sheets grasped by the binder (i.e. the extent to which first member 40 and second member 42 have been rotated relative to one another). The two openings through the first and second C-shaped members are preferably to be of a size that for any number of sheets grasped by the binder, the openings overlap to define opening 36 with sufficient circumferential extension.

Many other means for permitting free pivoting of binder 10 about axis 44, when coupled to the support structure 12, may occur to a person skilled in the art which effectively serve to hinge binder 10 to support structure 12 permitting free pivoting therebetween thereabout axis 44.

Many different coupling systems may be adopted to couple the first end 16 of binder 10 to the support structure. Preferably the coupling system will at least provide means to prevent substantial vertically downward displacement of the first end 16 of the binder with respect to the support means. Vertical support of the first end 16 by the support structure facilitates the manual operation of coupling the binder 10 to the support structure as discussed above. In the embodiment of FIG. 10 the abuttment of the lower surfaces of recession 118 with the lower surfaces of end cap 18 prevents vertical displacement of end 16 with respect to support structure 12.

Preferably the coupling system between the first end of the binder and the support structure will also permit at least pivoting of the first end of the binder about a vertical axis passing proximate the first end of the binder. This will permiy side-to-side pivoting of the binder. In the embodiment of FIG. 10, as discussed above, abuttment of corresponding surfaces of recession 118 and end cap 18 provide interfaces about which the binder may rotate.

Advantageously the coupling system between the first end of the binder and the support structure will provide means to prevent substantial horizontal movement of first end of the binder with respect to the support structure. In the embodiment of FIG. 10, this is accomplished by side walls of recession 118 abutting against side surfaces of end cap 118. Advantageously, the coupling system will also provide means to permit pivoting of the first end 16 of the binder about a horizontal axis normal to the longitudinal of the binder. This is also provided in the embodiment of FIG. 10 by the abuttment of corresponding surfaces of recession 118 and end cap 18 providing interfaces about which the binder 10 may pivot. Such pivoting is advantageous when engaging hook 30 within aperture 74 in the top of the binder, however, devices other than hook 30 may be provided so as to permit coupling without requiring binder 10 to be pivoted about a horizontal axis.

The coupling system between the first end of the binder and the support structure is seen in the preferred embodiments to inherently have restraining means to restrain the first end of the binder within end support means in opposition to force moments acting on the binder due to its suspension via rod 26, which force moments in the absence of such restraining means would act to substantially move the first end of the binder with respect to the end support means. For example, in the suspension structure of FIG. 10, the upper most surface of recession 118 may be seen to act as a reaction surface abutting on surface 103 of end cap 18 and retaining end cap 18 within recession 118. This is because the suspension of binder 10 by rod 26 coupled to opening 36 between the first end 16 and the center of gravity of the binder creates a force moment acting to pivot the first end upward about aperture 74. Similarly, end wall 120 of recession 118 acts as a reaction surface abutting on end face 124 of cap 18 to restrain cap 18 from movement further into recession 118. This is because the suspension of binder 10 by rod 26 with rod 26 hinged at ball-socket means 128 creates a force moment acting to pivot the binder about ball-socket 128 into recession 118.

In the embodiment shown in FIG. 10, the lower half of recession 118 could be removed to leave a U-shaped downward opening recession which would retain the first end of the binder therein. However, such a downward opening U-shape would have the disadvantage of not providing means to prevent vertically downward movement of the first end 16 advantageous when attempting to manually couple binder 10 to support structure 12.

In the event the opening 36 is moved to a point beyond the center of gravity from first end 16, the binder would have a tendency to pivot its first end downward and the upper half of recession 118 could satisfactorily be removed leaving an upward opening U-shaped recession.

Figure 11:
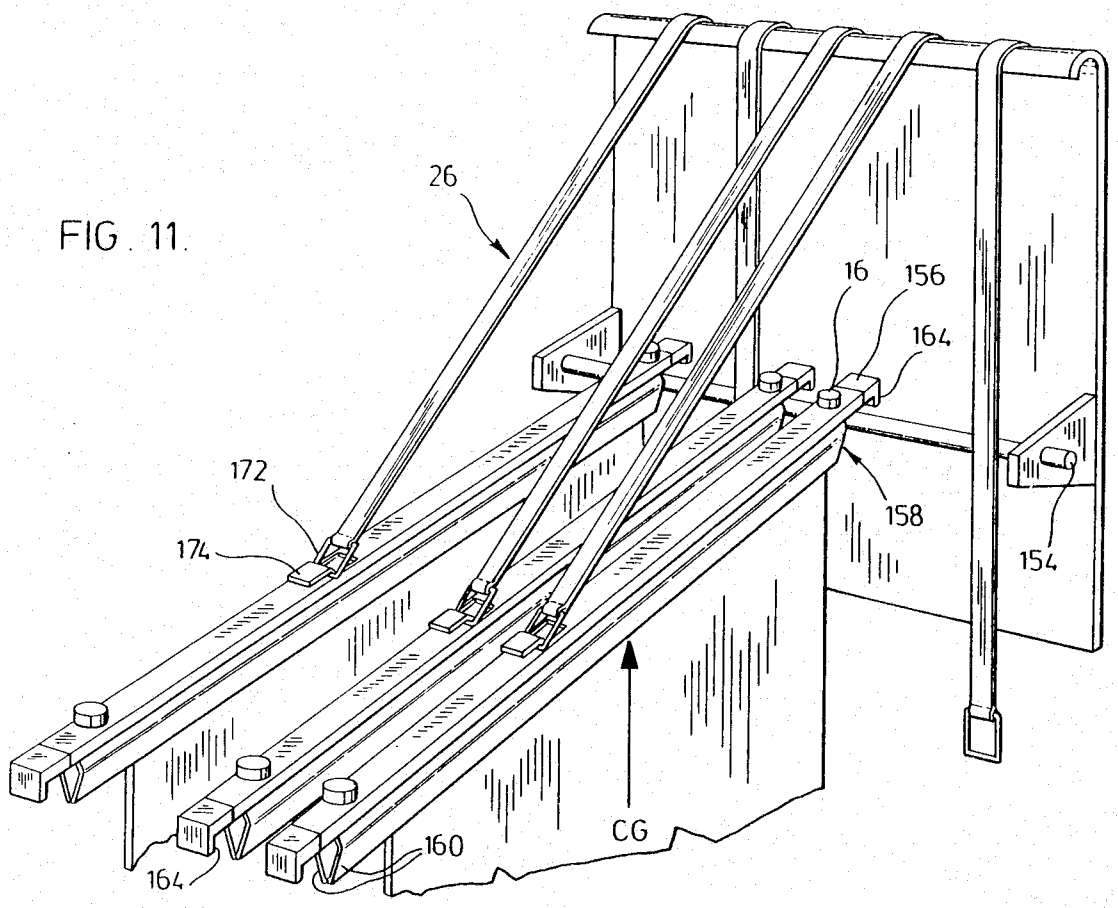
FIG. 11, is a perspective view showing a third form of the support structure of the present application adapted for use with a known three piece binder as described in Canadian Pat. No. 671,574.

FIG. 11 shows a third form of the support structure according to this application specifically adapted to suspend known three piece binder 10 such as those shown in Canadian Pat. No. 671,574. In this embodiment the end receiving means comprises the simple horizontally disposed rod 154 and the support means comprising a DACRON strap 26 similar to that shown in FIG. 1. The strap has a squared end loop 172 which is received in a bracket 174 on the top of the binder on the side of the center of gravity of the binder remote from its first end 16. Each end of the binder 10 has an extension 156 of the inverted channel. The end extension 156 at a first end rests on the top of rod 154. End faces 158 of the two clamping members 160 at the first end abut the side of the rod. While not necessary, means not shown could be provided to prevent substantial horizontal movement of the first end of the binder along rod 154. Preferably, the squared end caps on the binder may have a marginal downward extension or lip 164 at their extremities so that in the event the binder is rotated a substantial extent to one side, this downward extending lip will prevent rotation of the binder to an extent that it may become disengaged from abuttment with the top surface of rod 154. The embodiment shown in FIG. 11 may be swung from side-to-side. It may be seen to be easy to mount with the first end 16 received on top of the rod and the binder pivoted vertically upward until loop 172 can be received in bracket 174.

In the preferred embodiments shown in FIGS. 1 and 10 the coupling system between the first end 16 of the binder and the support structure has comprised in effect a ball-in-socket type arrangement with end cap 18 analogous to a ball and the end support means on the support structure analogous to a socket. An obvious adaptation of this preferred arrangement is to provide a fixed ball member, as for example a ball on a short rod fixed to and extending outward from the support structure in cooperation with, for example, a recess in one end of the binder to receive the ball. Further coupling systems according to this invention include as an end support means the simple horizontal rod as shown in FIG. 11.

Although this disclosure describes and illustrates preferred embodiments of the invention, it is to be understood that the invention is not limited to these particular embodiments. Many variations and modifications will now occur to those skilled in the art. For a definition of the invention reference is made to the appended claims.

What I claim is:

1. A clamping device to grasp sheet material along an edge thereof in combination with a support structure for suspending the device in a substantially horizontal position with sheet material grasped in the device to hang vertically downward therefrom, the clamping device comprising:

first and second continuous, elongate jaw-like clamping members of angle section between first and second longitudinal edges thereof, said clamping members hinged together along their first edges to pivot relative to one another about an axis for movement from an open position in which their second edges are sufficiently spaced to permit placement of said sheet material therein to a closed position in which their second edges are brought sufficiently close together to grasp said sheet material therebetween, said clamping members being hinged together with their angle sections opening towards each other to define an interior space bordered by interior surfaces of said first and second clamping members, tensioning means extending through said interior space coupling said first clamping member to said second clamping member for activation to regulate the distance therebetween for relative pivoting of said first and second clamping members between said open and closed positions, tension activating means located on an exterior surface of one of said first and second clamping members and coupled to the tensioning means for activating the tensioning means, said first and second clamping members being hinged together by:

a first substantially C-shaped section member provided on the first edge of said first clamping member defining therein a longitudinally extending groove of part-circle section of a first diameter, and a second part-cylinder member on the first edge of said second clamping member having a part-cylindrical exterior surface of a second diameter marginally smaller than the first diameter, said second part-cylinder member defining an aperture of substantially circular section therein coaxial with said axis; said second part-cylinder member longitudinally slidably receivable in said groove of the first C-shaped section member to be pivotable therein about said axis between said open and closed positions;

a first opening provided radially through the first C-shaped section member; a second opening provided radially through the second part-cylinder member;

whereby with the first and second clamping members in longitudinal alignment, the first and second openings align and provide for access from a top of an assembled device into the aperture of circular section throughout all open and closed positions;

said clamping device being detachably supported from the support structure with the clamping device substantially free to pivot as a unitary body about said axis through which the first and second clamping members are hinged for pivoting with respect to one another;

pivoting permitting means coupling the support structure to the device and permitting pivoting of the device as a unitary body about said axis, said pivoting permitting means passing through said first and second openings and contacting interior surfaces of said aperture proximate said first and second openings.

2. The combination of claim 1 wherein said pivoting permitting means comprising a hooklike member to extend through said first and second openings and locate a protrusion of part-circular section within said aperture.

3. A clamping device to grasp sheet material along an edge thereof comprising:

first and second continuous, elongate jaw-like clamping members of substantially identical angle section between first and second longitudinal edges thereof;

said clamping members hinged together along their first edges to pivot relative to one another from an open position in which their second edges are sufficiently spaced to permit placement of said sheet material therein to a closed position in which their second edges are brought sufficiently close together to grasp said sheet material therebetween;

said clamping members being hinged together with their angle sections opening towards each other to define an interior space bordered by interior surfaces of said first and second clamping members;

tensioning means extending through said interior space coupling said first clamping member to said second clamping member for activation to regulate the distance therebetween for relative pivoting of said first and second clamping members between said open and closed positions;

tension activating means located on an exterior surface of one of said first and second clamping members and coupled to the tensioning means for activating the tensioning means;

said first and second clamping members being hinged together by:

a first substantially C-shaped section member provided on the first edge of said first clamping member defining therein a longitudinally extending groove of part-circle section, a second substantially C-shaped section member on the first edge of said second clamping member defining an aperture of substantially circular section therein; said second C-shaped section member longitudinally slidably receivable in said groove of the first C-shaped section member to be pivotable therein between said open and closed positions; a longitudinal, radially inward extending stop flange provided on an interior surface of said groove positioned at a circumferential location to abut an extremity of one arm of the second C-shaped section member thereby limiting the extent of pivoting of said first and second clamping members with respect to one another;

spring means received in said aperture of circular section, two radial projections on said spring means extending from said aperture to both lie between said extremity of said one arm of said second C-shaped section member and said stop flange, one projection abutting said extremity and the other projection abutting said stop flange whereby said spring means biases the extremity circumferentially away from the stop flange thereby biasing the first and second clamping members towards the open position.

4. A clamping device as claimed in claim 3 further comprising:

a depending flange on said first clamping member lying intermediate the first clamping member and second clamping member in said interior space, said depending flange in section extending from the interior surface of said first clamping member towards the interior surface of said second clamping member whereby with the device in said closed position a portion of said depending flange lies proximate the interior surface of the second clamping member in opposed relation thereto;

said tensioning means coupling said portion of said depending flange to said second clamping member for activation to regulate the distance between said portion of said depending flange and the interior surface of the second clamping member opposed thereto for relative pivoting of said first and second clamping members between said open and closed positions; and wherein said groove of said first C-shaped section member encircling said second C-shaped section member to an extent greater than 180° to prevent radial removal therefrom.

5. A clamping device to grasp sheet material along an edge thereof comprising:

first and second continuous, elongate jaw-like clamping members of substantially identical angle section between first and second longitudinal edges thereof;

said clamping members hinged together along their first edges to pivot relative to one another about an axis for movement from an open position in which their second edges are sufficiently spaced to permit placement of said sheet material therein to a closed position in which their second edges are brought sufficiently close together to grasp said sheet material therebetween;

said clamping members being hinged together with their angle sections opening towards each other to define an interior space bordered by interior surfaces of said first and second clamping members;

said first and second clamping members being hinged together by:

a first substantially C-shaped section member provided on the first edge of said first clamping member defining therein a longitudinally extending groove of part-circle section of a first diameter; and a second part-cylinder member on the first edge of said second clamping member having a part-cylindrical exterior surface of a second diameter marginally smaller than the first diameter, said second part-cylinder member being longitudinally slidably received in said groove of the first C-shaped section member to be pivotable therein about said axis between said open and closed positions, a depending flange extending, from an extremity of said first C-shaped section member within said interior space, into said interior space in a substantially radial direction with respect to said axis, with the clamping device in said closed position said flange lying proximate an interior surface of said second clamping member in opposed relation to a hole passing through said second clamping member, an elongate bolt member coupled to said flange to extend substantially normal to said flange through said hole for activation by tension activating means on an external surface of said second member to regulate the distance between said flange and the second member for relative pivoting of said first and second members between said open and closed positions.

* * * * *

United States Patent [19]

Kooiman

[11] Patent Number: 4,503,980

[45] Date of Patent: Mar. 12, 1985

[54] DEVICE FOR STACKING OF ARTICLES OF WHICH THE UPPER MOST ARTICLE OF THE STACK IS MAINTAINED AUTOMATICALLY AT A CERTAIN LEVEL

[76] Inventor: Pieter L. Kooiman, 17 Achterambachtweweg, Hendrik Ido Ambacht, Netherlands

[21] Appl. No.: 433,717

[22] Filed: Oct. 12, 1982

[30] Foreign Application Priority Data

Jun. 15, 1982 [DE] Fed. Rep. of Germany ... 8217130[U]
Jun. 18, 1982 [EP] European Pat. Off. ..... 82200768.8

[51] Int. Cl.[3] ..... A47F 1/06

[52] U.S. Cl. ..... 211/41; 108/136; 211/59.2; 312/71

[58] Field of Search ..... 211/49 D; 108/136; 312/71, 42; 220/93; 221/279

[56] References Cited

U.S. PATENT DOCUMENTS

| | | | |
|---|---|---|---|
| 2,435,104 | 1/1948 | Solomon | 312/71 X |
| 2,816,808 | 12/1957 | Haines | 312/71 |
| 3,428,185 | 2/1969 | Vorndran | 108/136 X |
| 3,863,576 | 2/1975 | Olsson | 108/136 |

FOREIGN PATENT DOCUMENTS

| | | | |
|---|---|---|---|
| 7810423 | 4/1980 | Netherlands . | |
| 946227 | 1/1964 | United Kingdom | 211/49 D |
| 1596779 | 8/1981 | United Kingdom . | |

*Primary Examiner*—Robert W. Gibson, Jr.
*Attorney, Agent, or Firm*—Andrus, Sceales, Starke & Sawall

[57] ABSTRACT

Device for stacking of articles of which the upper most article of the stack is maintained automatically at a certain level.

The device comprises a vertical container for the stack of articles, said container having an opening at the upper side around which an annular flange is arranged, on which a number of main tension springs is suspended, which support the body part of a carrier, whereas the supporting plane part of the carrier rests on the body part of the carrier by means of preferentially a single central helical compression spring, having a diameter approaching the main dimension of the carrier.

The strength of this helical compression spring is weaker than that of the body springs, so that at loading with a stack of articles, the supporting plane moves down resiliently faster, and also a greater part of the carrier is used for the stack of articles and thereby an increase of capacity is obtained, with stable support for the stack of articles.

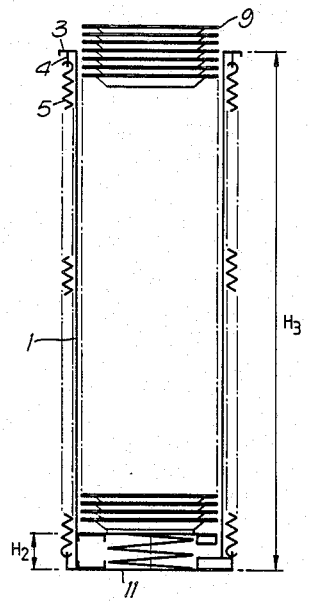

2 Claims, 2 Drawing Figures